US005825026A

United States Patent [19]

Baykut

[11] Patent Number: 5,825,026

[45] Date of Patent: Oct. 20, 1998

[54] INTRODUCTION OF IONS FROM ION SOURCES INTO MASS SPECTROMETERS

[75] Inventor: Gökhan Baykut, Bremen, Germany

[73] Assignee: Bruker-Franzen Analytik, GmbH, Bremen, Germany

[21] Appl. No.: 896,207

[22] Filed: Jul. 17, 1997

[30] Foreign Application Priority Data

Jul. 19, 1996 [DE] Germany ..... 196 29 134.8

[51] Int. Cl.[6] ..... H01J 49/00

[52] U.S. Cl. ..... 250/288; 250/290; 250/292

[58] Field of Search ..... 250/288, 290, 250/292, 281, 282

[56] References Cited

U.S. PATENT DOCUMENTS 3,473,020 10/1969 Brubaker .
5,179,278 1/1993 Douglas ..... 250/290
5,668,370 9/1997 Yano et al. ..... 250/288

FOREIGN PATENT DOCUMENTS 0237259 9/1987 European Pat. Off. .
53-33689 3/1978 Japan .

OTHER PUBLICATIONS

*The 44th ASMS Conference on Mass Spectrometry and Allied Topics,* p. 1134, May 12–16, 1996, Portland, Oregon.
Quadrupole Mass Spectrometry and its applications, pp. 34 and 62, 1976 Peter H. Dawson.

*Primary Examiner*—Kiet T. Nguyen

[57] ABSTRACT

Curved rf multipole ion guides or angled linear rf multipole ion guides are designed to be rotatable or shiftable. Thus, the direction of guided ions can be altered by rotating or shifting these ion guides. In a mass spectrometer equipped with a multitude of ion sources, this allows to switch between ion sources without venting the vacuum system.

14 Claims, 8 Drawing Sheets

INTRODUCTION OF IONS FROM ION SOURCES INTO MASS SPECTROMETERS

FIELD OF THE INVENTION

The invention relates to a device and a method for transferring ions generated in ion sources into a mass spectrometer. The invention consists in designing known ion guides (rf multipole arrangements) which are curved at a certain angle, rotatable or shiftable. Thus, the origin of the ions can be altered using a manipulator either manually or under computer control in a mass spectrometer equipped with several ion sources, without needing to vent the vacuum system.

PRIOR ART

The generation of ions within ion traps has disadvantages since the sample to be ionized must be introduced into the ion trap. Here, ion traps mean both the quadrupole rf ion traps according to Paul, and the electromagnetic ion cyclotron traps according to Penning. For large molecules which decompose when heated, there are alternative ionization methods such as electrospray or laser desorption ionization (and also matrix-assisted laser desorption ionization =MALDI). These methods are much more simply applied in an external ion source than in or directly at the ion trap itself. For ion sources which generate ions outside the vacuum system of a mass spectrometer, e.g. at atmospheric pressure (atmospheric pressure ionization=API), these ions are then transferred through a special capillary into the vacuum system of the mass spectrometer. Electrospray ionization (ESI) and ionization by inductively coupled plasma (ICP) and chemical ionization under atmospheric pressure (atmospheric pressure chemical ionization=APCI) are among these. ESI helps in the ionization of substances with a high molecular weight, (CP is used for the analysis of inorganic compounds. APCI ionizes gas molecules through ion-molecule reactions (chemical ionization), the primary ions being generated by a corona discharge. For ion cyclotron resonance spectrometry (ICR), an additional requirement is that the measurement must take place under ultra-high vacuum conditions, such as at $10^{-6}$–$10^{-9}$ mbar, to achieve the best results. Application of the above mentioned methods is however associated with a strong increase of pressure in the vacuum system. Therefore, differentially pumped external ion sources are very often used for ICR spectrometers.

In mass spectrometry, ion guide arrangements have been used for years in order to transfer ions between two parts of the spectrometer. In ICR mass spectrometry, various quadrupole ion guide systems have been introduced in order to transfer the ions formed in an external ion source into the ICR trap. After their generation, the ions are introduced from the source using an ion guide system in the magnetic field, in which the ICR trap is located. The American patent U.S. Pat. No. 5,179,278, for example, describes a multipole inlet system for ion traps. Here, the substances are transferred after ionization into the ion trap using a multipole ion guide.

Some tandem mass spectrometers have ion guide arrangements between the two mass spectrometer stages. In triple quadrupole mass spectrometers, for example, the ions selected in the first ion filter (first quadrupole) move into the second mass filter (third quadrupole) via a collision chamber in which an ion guide system (second quadrupole) is located. A collisionally induced dissociation of these ions takes place there. The product ions are analyzed in the third quadrupole.

The noise in the mass spectrum on tandem quadrupole spectrometers is explained by the fact that excited and fast neutral particles fly toward the detector on the same path as the ions and collide with gas molecules or impact onto the surfaces in the direct vicinity of the detector. In this way, ions are created which then produce additional ion signals in the detector. Also light quanta from the ion source can produce such ions. Lately, curved multipole ion guide systems between the first and the third quadrupole mass spectrometer stage have been used for this reason.

Peter H. Dawson mentions in his classical book "Quadrupole Mass Spectrometry and Its Applications" (Elsevier, 1976, page 35) curved quadrupole ion guides. Curved multipoles are first described in the U.S. Pat. No. 3,473,020 (1969). This patent is about a non-magnetic mass analyzer, which is made of linear and curved electrodes. The invention is described using examples of a quadrupole, a dipole and a monopole, which consists of a cylindrical rod-electrode and a right-angled counter electrode. The use of curved electrodes has the advantage of reducing the noise in the mass spectrum. Since neutral particles and photons are not affected by the electric field, they keep flying straight and no longer come in the vicinity of the detector, therefore cause no noise.

The European patent application 0 237 259 dated Mar. 4, 1987, describes a tandem quadrupole mass spectrometer with a curved multipole ion guide arrangement for reducing the noise in the mass spectrum.

A system consisting of a multitude of ion sources combined with a mass spectrometer, is in the Japanese patent application JP 53-33 689 (A2) described. However, this source complex uses no multipole ion guides. these ion sources produce ions continuously. By applying appropriate potentials to a deflection electrode pair, ions from these sources can be transferred into the mass spectrometer.

For an ion trap mass spectrometer such as the Fourier transform ion cyclotron resonance spectrometer (FTICR), various ion sources are often used to generate ions. From gaseous substances or from substances which can easily be transferred into the gas phase, positive or negative ions are produced through electron ionization (EI). Through ion-molecule reactions, secondary ions can be generated in an ion source from primary ions, e.g. from an ionized gas (chemical ionization, CI). Alternative ionization methods such as laser desorption ionization (LDI), matrix-assisted laser desorption ionization (MALDI), electrospray ionization (ESI), or ionization through bombardment with fast atoms (fast atom bombardment=FAB) and others make up a broad palette of possibilities and techniques which can be used with an FTICR spectrometer or an rf ion trap mass spectrometer. Especially MALDI and ESI are being used more and more in recent years in order to analyze relatively large organic molecules of biological significance. These ion sources are normally attached individually in the external source region of each mass spectrometer, and a change of source is associated with interruption of the vacuum. By complicated mechanical arrangements, some ion sources can be combined, such as for example EI and CI sources, sometimes even a MALDI source together with EI and CI. But these combinations always have the disadvantage that the functions of the sources involved are limited through compromises. On the other hand, the operating conditions of a source prevent immediate use of the other source in the combination. Directly after MALDI experiments with a MALDI/EI source, it is often not possible to start with EI mass spectrometry, for example, since the combined ion source is now contaminated with matrix molecules. These slowly make their way into the gas phase when the filament is switched on. Baking out the ion source often solves the problem, though this means a loss of time in routine operation.

In a commercial system (Finnigan/FTMS System, Brian Winger, Proceedings of the 44th ASMS Conference on Mass Spectrometry and Allied Topics, Portland, Oreg., USA, May 12–16, 1996, page 1134), MALDI and electrospray ion sources were used for FTICR spectrometry in such a way that these were placed to both sides of a superconducting magnet and the ions enter the ICR trap from both sides. However, while the electrospray is placed outside the magnetic field as an external source, the laser target of MALDI source is placed almost directly at the ICR trap. The ions directly enter the ICR trap without needing any ion guide at all.

OBJECTIVE OF THE INVENTION

It is the objective of the invention to find a device and a method by which ions can be transferred from various ion sources placed in a source region into a mass spectrometer, without needing to vent the vacuum system. This mass spectrometer may be an rf ion trap, an electromagnetic ion trap (ICR spectrometer) or even a transmission mass spectrometer (quadrupole or, sector).

BRIEF SUMMARY OF THE INVENTION

The basic idea of the invention is to movably position one or several curved multipole ion guides, so that in a system of multiple stationary ion sources, each source can be used one after another by adjusting the movable multipole. The ions originating from various ion sources, which however are directed toward a common point, can be introduced into the mass spectrometer, using a rotatable multipole ion guide arrangement. The ions can be transferred directly into an rf ion trap or into a quadrupole or sector mass spectrometer, or also an ion transfer line of a FTICR spectrometer. For this purpose, a multipole (e.g. a hexapole or octopole) is positioned adjustably around the axis of the ion trap or around of the axis of the ion transfer path of the FTICR mass spectrometer. The curved longitudinal axis of the multipole on the mass spectrometer side (injection side) is identical to the rotation axis of the rotatably positioned multipole. During a rotation, the other end of the multipole moves in a circle passing various ion sources. The rotation position of the multipole determines from which ion source the ions are transferred into the mass spectrometer.

Another movable multipole system consists of an insulator platform with curved multipoles mounted on it, the opposite ends of which point to different directions. The vertically shiftable platform is mounted before the ion transfer line of a FTICR spectrometer. By shifting the platform, ions from each of the other ion sources are collected in the ion transfer path.

For small angles, a linear multipole, mounted at an angle and of course also rotatable or shiftable, can replace the curved multipole. The angle between the rotation axis of the linear multipole and its longitudinal axis is here not zero.

Both of the above mentioned arrangements can be operated, for example, by an external motion transfer device. A translational movement is transferred, for example, through a bellows into the vacuum system where it is translated into a rotation movement, in the case of a rotatable multipole ion guide.

Curved multipole systems designed to be rotatable or shiftable can also temporarily store ions as has been described in the American patent U.S. Pat. No. 5,179,278 for a multipole inlet system—although in the case of a linear multipole. To do this, apertured end plates are placed to both ends of the curved multipole, which reflect the ions back into the center of the multipole. Through pulses from the positive voltage of one of these end plates at zero or at small negative values, accumulated positive ions can be released in the appropriate direction.

In the case of a rotatable multipole arrangement which joins several ion sources to the mass spectrometer, this storage function has the advantage that ions from one source can be accumulated in the multipole, after which the curved rotatable multipole is rotated and further ions can be added to it from a second source. In this way, ions which can only be generated by a specific ionization method can be measured together with ions of a different origin in an ion trap mass spectrometer, for example. A practical example would be the sample generation of polyethyleneglycol ions with the help of a MALDI source. Polyethyleneglycols with different degrees of polymerization provide multi-peak patterns with known masses in selected mass ranges, which are very suitable for mass calibration of the mass spectrometer. Unfortunately there are no equally good calibration substances which can be so favorably ionized by electrospray. For this reason, a simultaneous measurement of ions from MALDI and ESI sources is sometimes a solution for problems in mass spectrometry.

BRIEF DESCRIPTION OF THE FIGURES

Short descriptions of the figures are given below. A thorough explanation with all details is given in the chapter "Embodiments".

PREFERRED EMBODIMENT

One embodiment described here relates to a curved and rotatably designed rf hexapole ion guide arrangement which can be integrated between ion sources and the mass spectrometer. A further embodiment consists of a set of multipole ion guide arrangements fitted together on a platform and at least one of which is curved. Here, the switchover procedure occurs by adjusting this platform, whereby now a multipole curved in a different direction takes over the ion transmission. In both versions designed as rotatable or as shiftable, only rf or also rf/dc operation of the multipoles can be considered to ensure an ion transfer which is as efficient as possible.

For small angles, a linear multipole designed of course as rotatable or shiftable, mounted at an angle, can replace the curved multipole. Here the angle between the rotation axis of the linear multipole and its longitudinal axis is not zero.

A special embodiment of the invention is that the rotatably positioned ion guide is used as just one part of the entire ion guidance system. One example is an arrangement consisting of an electrospray and a MALDI ion source, connected to an rf quadrupole ion trap. Both sources can each have their own linear multipole ion guides which meet in the vicinity of the ion trap. The curved rotatable multipole is used here only on the short path between the ends of the individual multipole ion guides and the ion trap. The system described is used in exactly the same manner for an ion cyclotron resonance mass spectrometer, where the rotatable arrangement is attached in front of the standard ion transfer path of the ICR spectrometer.

In FIGS. 1–8, different embodiments are illustrated.

Figure 1A:
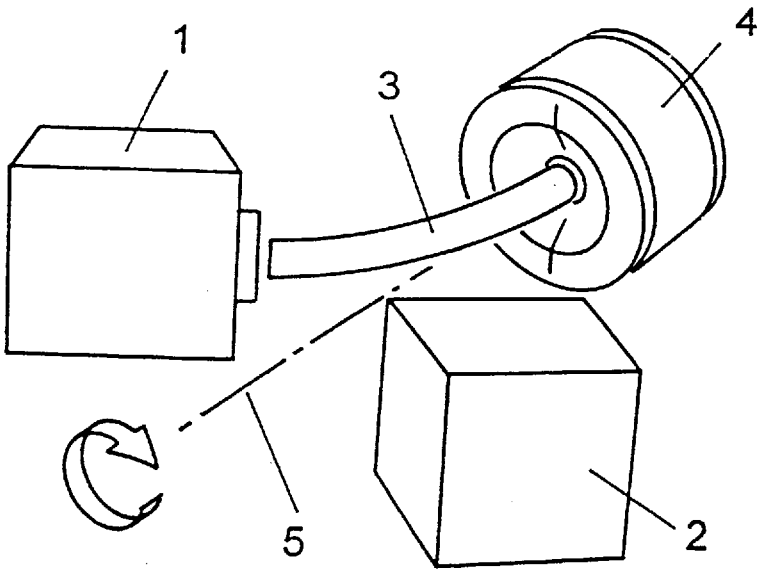
FIG. 1 schematically represents the function of a curved multipole designed to be rotatable.
Figure 1B:
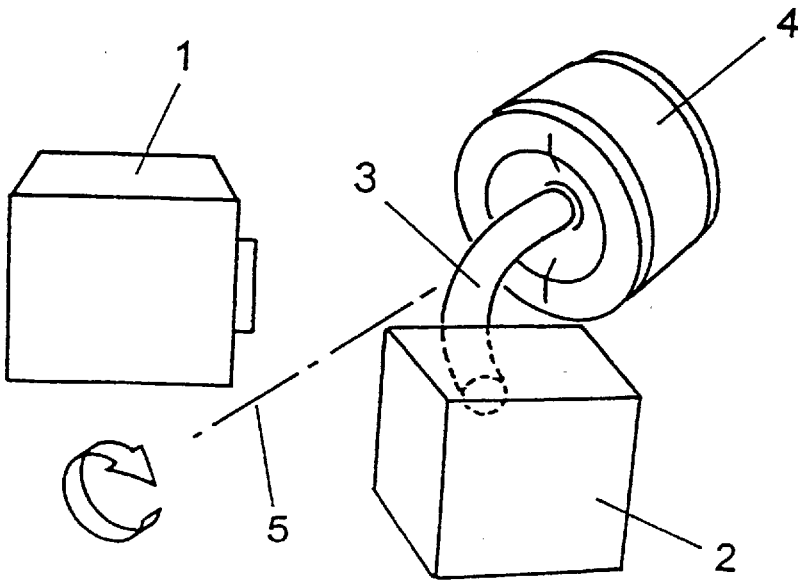

FIG. 1 schematically represents the operation of a rotatably designed curved multipole. (1) is the first ion source, (2) is the second ion source, (3) is the rotatable, curved multipole ion guide and (4) is the rf ion trap as an example for a mass spectrometer. In FIG. 1*a*, the ion guide connects the first ion source to the mass spectrometer. In FIG. 1*b*, it is rotated 180° and now connects the second source to the mass spectrometer. (5) is the rotation axis of the multipole in this embodiment. Both the ion guide and the ion trap are of course located in the vacuum system. The depicted ion sources are also—depending on the type —at least partially placed in the vacuum system.

Figure 2A:
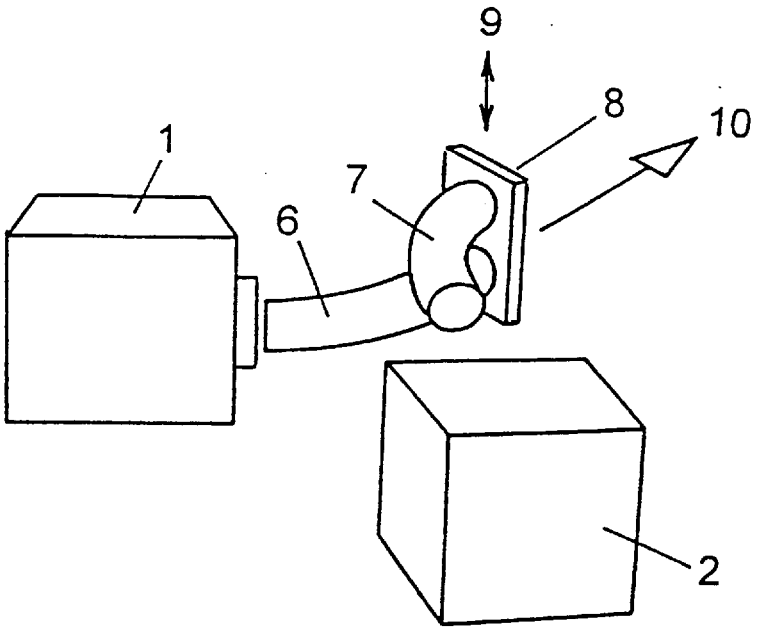
FIG. 2 schematically represents the function of the multipole system designed to be shiftable.
Figure 2B:
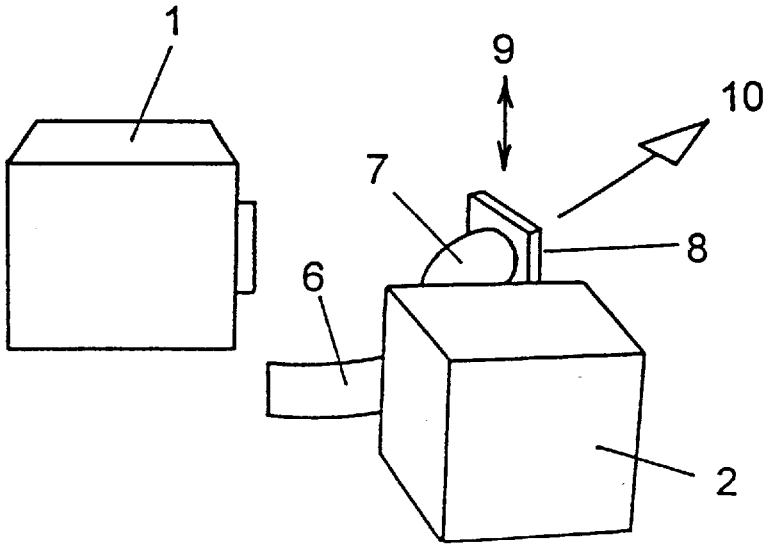

FIG. 2 schematically represents the operation of the rf multipole system designed to be shiftable. (1) is again the first ion source, (2) is the second ion source, (6) the multipole directed toward the first ion source, (7) the multipole directed toward the second ion source. (8) is the platform upon which both multipoles are mounted, and (9) is the direction of the platform movement for the purpose of switching over the ion sources. (10) represents the direction in which the ions emerge from the curved multipole, which obviously leads to the mass spectrometer. In FIG. 2*a*, the multipole accepts the ions formed in the first source. By adjusting the platform downward (FIG. 2*b*), it can be switched over to the second source. It is also apparent here that both the ion guide and the ion trap are placed in the vacuum system. The depicted ion sources are also—depending on the type—at least partially placed in the vacuum system.

Figure 3:
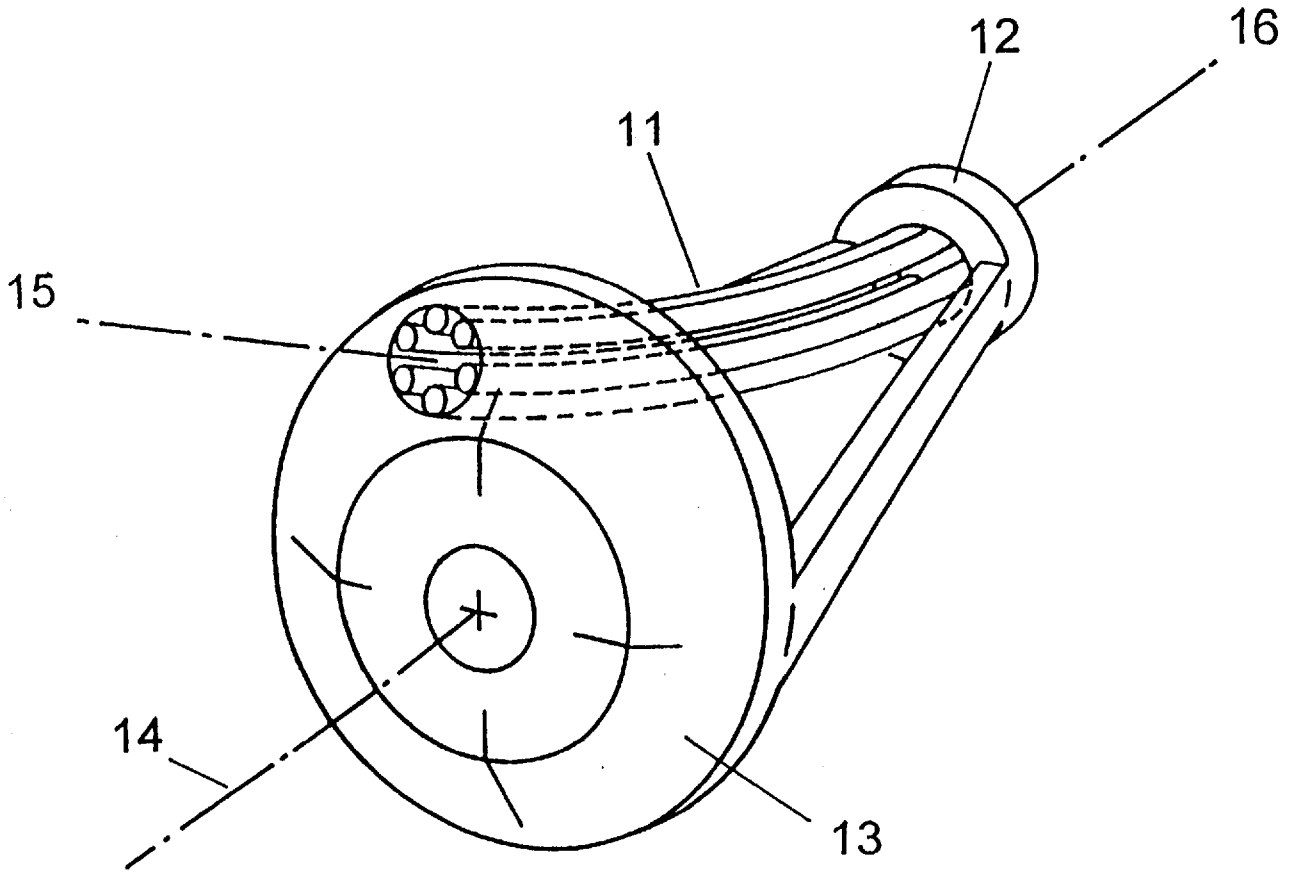
FIG. 3 shows a possible design of the curved multipole.

FIG. 3 shows a possible embodiment of the curved multipole. (11) is a curved hexapole as an example, which is mounted to plates (12) and (13). The rotation axis of the system is (14). (15) is the direction of entry of the ions and (16) the direction of exit, which in this case is identical to the rotation axis (14).

Figure 4:
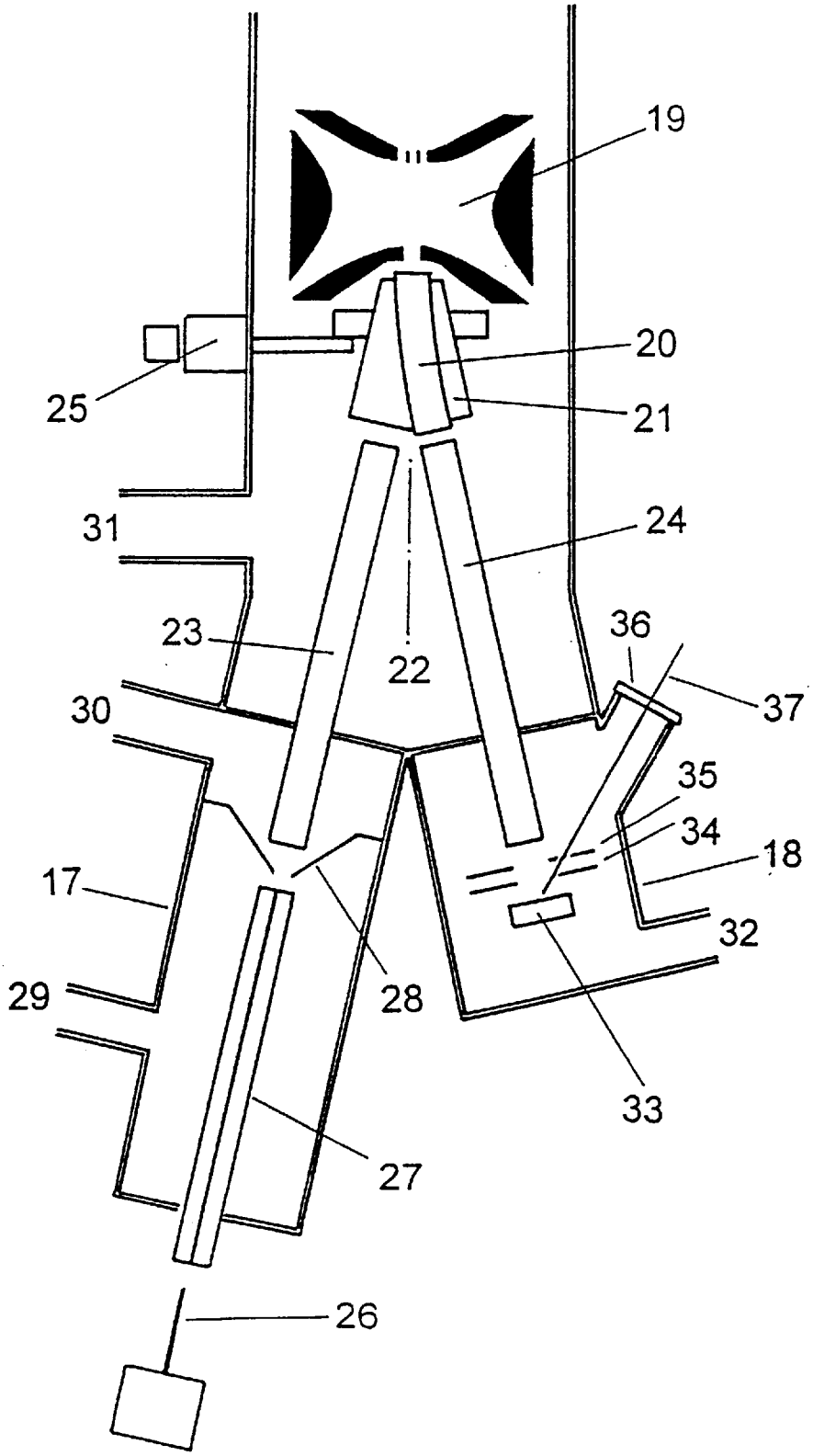
FIG. 4 shows a possible application by which an electrospray ion source and a MALDI ion source of an rf ion trap mass spectrometer is represented.

FIG. 4 shows a possible application, by which an electrospray ion source (17) and a MALDI ion source (18) of an rf ion trap mass spectrometer (19) is represented. The curved multipole (20) is mounted in a mechanical frame (21), rotatable around an axis (22) similar to that in FIG. 3, and it performs the ion guidance here only along a short partial path between the ion source and the ion trap (19). The ions which emerge from the sources are first transported through conventional static multipole ion guides (23 and 24). In the position illustrated, the rotatable ion guide transfers only the ions which are produced in the MALDI source into the ion trap. By 180° rotation using a mechanical switching arrangement (25), the curved hexapole can be used for transfer of ions from the electrospray source (17). Simple details of the electrospray and the MALDI source are indicated in the figure. (26) is the electrospray needle; (27) the entrance capillary, (28) the skimmer, (29) the pump line from the first differentially pumped stage, (30) the pump line from the second differentially pumped stage, (31) pump line of the vacuum system of the ion trap, (32) pump line of the first vacuum stage of the MALDI source, (33) the sample holder for MALDI, (34 and 35) focusing lenses, (36) the laser window and (37) the laser beam which hits the sample.

This illustration represents an example of injection of ions into an ion trap. The setup shown here for an ion trap mass spectrometer could be also used for an ion cyclotron resonance mass spectrometer.

Figure 5:
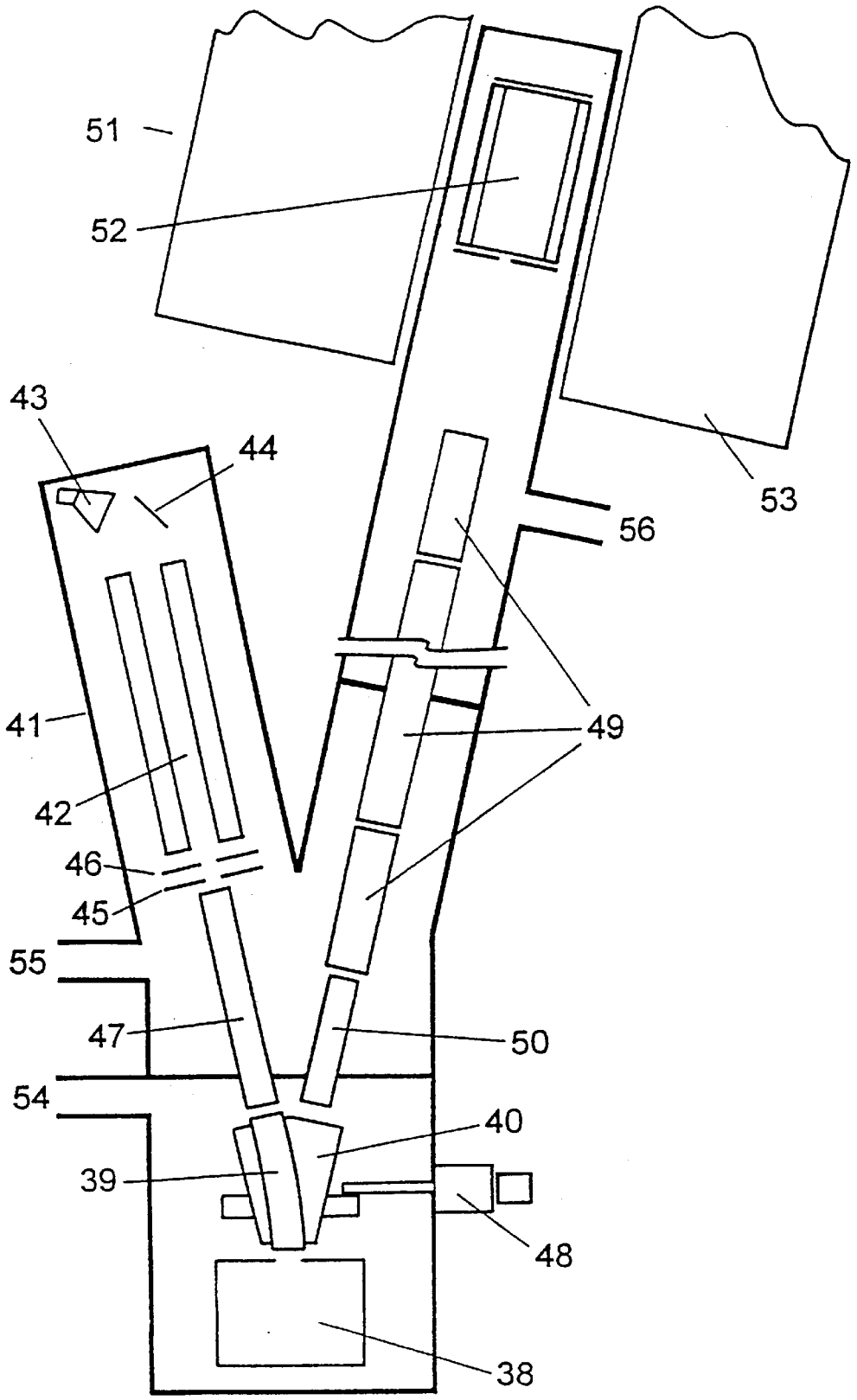
FIG. 5 shows an example in which a single ion source, using a curved ion guide arrangement installed in a rotatable frame, is combined with two different mass spectrometers.

FIG. 5 shows an example in which an ion source (38) is combined with two different mass spectrometers using a curved ion guide arrangement (39) which is built into a rotatable frame (40). (41) is a quadrupole mass spectrometer, (42) the quadrupole mass filter, (43) the secondary ion multiplier, (44) the reflection plate, (45 and 46) are focusing lenses, (47) a linear ion guide which transfers the ions emerging from the curved multipole to the mass filter. In the position illustrated, the ions are transferred into the quadrupole mass spectrometer. By rotation using the mechanical switchover device (48), the curved multipole can be switched over in such a way that the ions are introduced into the ion transfer lines (49 and 50) of the ICR spectrometer (51), by which they move into the ICR trap (52), which is located in a strong magnet (53). This magnet (53) is only partially drawn in the figure.

Figure 6:
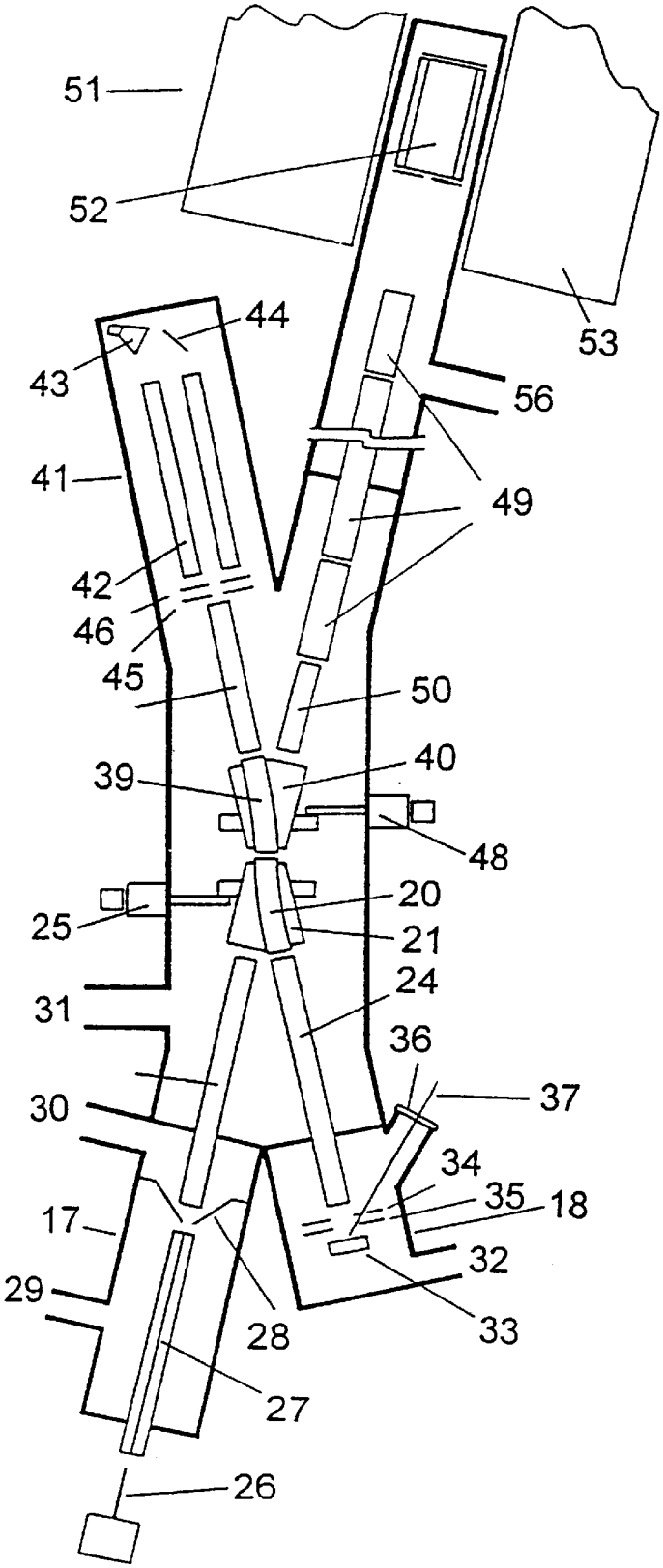
FIG. 6 shows a system consisting of two mass spectrometric arrangements and two ion sources. Through independent rotation of two curved multipole ion guides connected one behind the other, either source can be combined here with either mass spectrometer.

FIG. 6 shows a system consisting of two mass spectrometric arrangements and two ion sources. Through independent rotation of two curved multipole ion guides placed in series, either source can be connected to either mass spectrometer here. In the position illustrated, ions from the MALDI source are transferred into the quadrupole mass spectrometer. All the numbers used in this figure were already described in the previous paragraphs.

Figure 7:
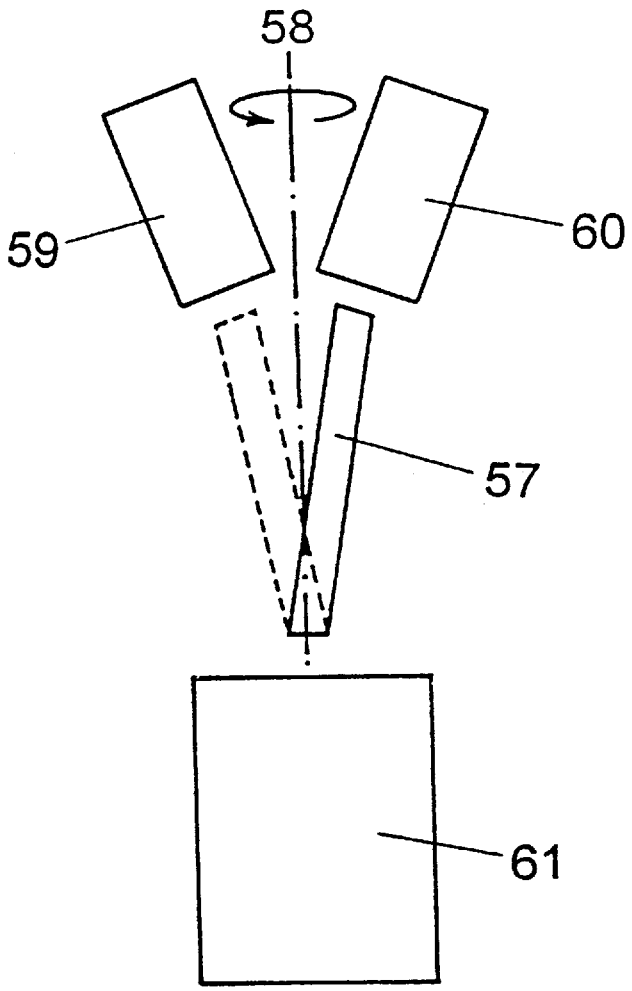
FIG. 7 is an example of the case, where a rotatable ion guide does not consist of a curved multipole but instead of a linear multipole set up at an angle.

FIG. 7 is an example for a case in which a rotatable ion guide does not consist of a curved multipole, but rather of a linear multipole (57) set up at an angle. It is rotatable around the axis (58). (59) and (60) are two sources used alternatively. (61) is the mass spectrometer.

Figure 8:
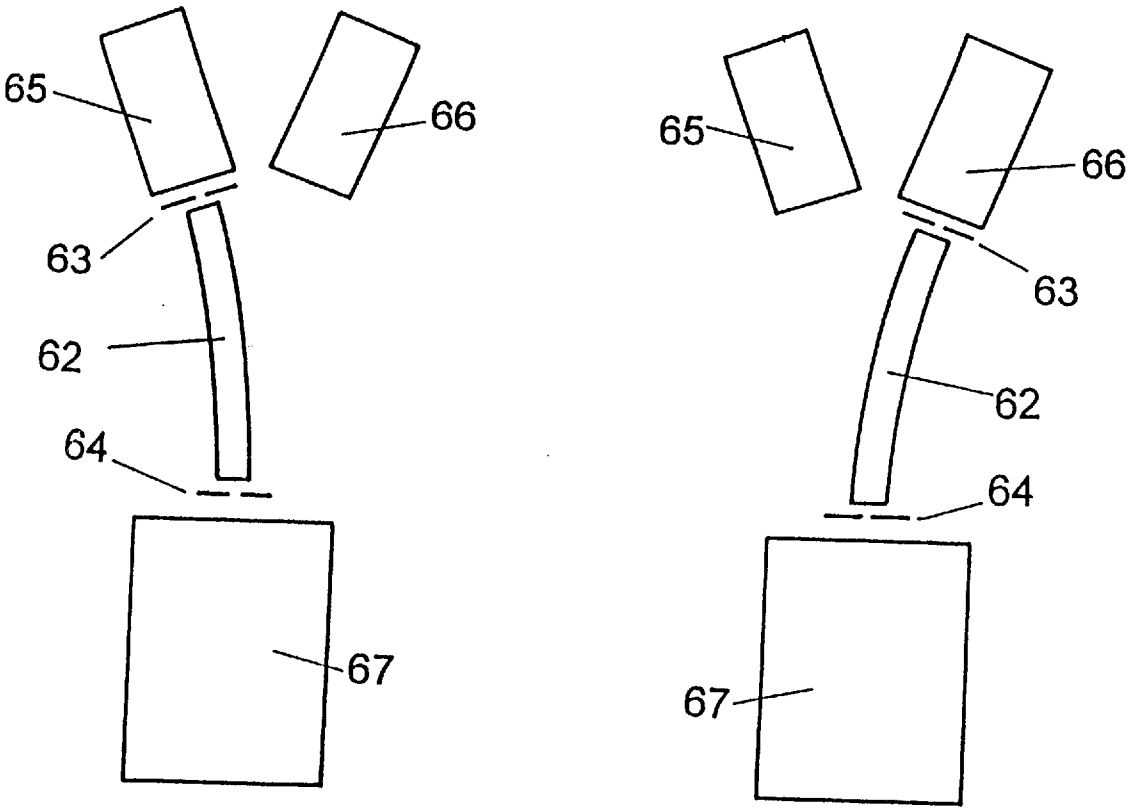
FIG. 8 describes the method that if for a curved rotatable multipole, ions from two ion sources can be accumulated in succession and measured together.

FIG. 8 describes the method that, if end plates (63) and (64) are used for a curved rotatable multipole (62) to accumulate ions in the multipole (storage function), ions are accumulated from the one source (65). The multipole can be rotated without losing the ions, and other ions generated by a different method from the second source (66) can be added to them. All ions can be injected together into the mass spectrometer (67) and detected.

I claim:

1. Mass spectrometer comprising (a) a set of ion sources (b) a set of, at least one, mass spectrometric analyzers (c) an rf multipole ion guide movable in such a way, that ions from a selected ion source can be transferred into a selected mass spectrometric analyzer.

2. Mass spectrometer as in claim 1, wherein the movable rf multipole ion guide is equipped with end apertures to store ions intermediately.

3. Method for mass spectrometric measurement of ions using a mass spectrometer according to claim 2, comprising the steps of:

(a) producing a stream of ions, (b) storing ions using the movable rf multipole ion guide as an intermediate ion trap, (c) pulse-discharging the stored ions from the movable rf multipole ion guide into the mass spectrometric analyzer, and (d) analyzing ions in the mass spectrometric analyzer.

4. Method for mass spectrometric measurement of ions using a mass spectrometer according to claim 2, comprising the steps of (a) producing a stream of ions using a first ion source (b) storing ions using the movable rf multipole ion guide as an intermediate ion trap, (c) turning the rf multipole ion guide to a second ion source, (d) producing ions from the second ion source (e) adding ions produced in this second ion source into the rf multipole ion guide and storing them, (f) if desired, repeating the steps (c) to (e) for other ion sources of interest, (g) pulse-discharging the accumulated ions from all selected ion sources out of the movable rf multipole ion guide into the mass spectrometric analyzer, and (h) analyzing ions in the mass spectrometric analyzer.

5. Mass spectrometer as in claim 1, wherein the rf multipole ion guide is curved and is mounted at its one end rotatable around the linear extension of the multipole's curved longitudinal axis.

6. Mass spectrometer as in claim 1, wherein more than one curved rf multipole ion guides are fixed at their one end at a shiftable platform.

7. Mass spectrometer as in claim 1, wherein more than one linear rf multipole ion guides are fixed at their one end at an angle on a shiftable platform.

8. Mass spectrometer as in claim 1, wherein the movably designed rf multipole ion guide is only one part of an ion guidance line for transferring ions from primary ion guides into the mass spectrometric analyzer.

9. Mass spectrometer as in claim 1, wherein a curved rf multipole ion guide is rotatably mounted around an axis that corresponds to a tangent of the multipole's curved longitudinal axis.

10. Mass spectrometer as in claim 1, wherein a curved rf multipole ion guide is rotatably mounted around the optical axis of the entrance of the mass spectrometric analyzer, in order to accept ions from different ion sources depending on the angle of rotation, and to transfer them into the mass spectrometric analyzer.

11. Mass spectrometer as in claim 1, wherein a curved rf multipole ion guide is rotatably mounted around the optical axis of the ion source exit, in order to transfer ions generated in the ion source into different mass spectrometric analyzers, depending on the rotational angle of the curved rf multipole ion guide.

12. Mass spectrometer as in claim 1, wherein two curved rf multipole ion guides, designed to be movable independent of each other, are mounted in series, in order to allow a coupling between a multitude of ion sources and a multitude of mass spectrometric analyzers.

13. Mass spectrometer as in claim 1, wherein a linear rf multipole ion guide is fixed at an angle onto a platform, which is mounted perpendicular to and rotatable around the optical axis of the entrance of the mass spectrometric analyzer, in order to transfer ions generated in different ion sources, depending on the rotational angle of the linear rf multipole ion guide, into the mass spectrometric analyzer.

14. Mass spectrometer as in claim 1, wherein a linear rf multipole ion guide is fixed at an angle onto a platform, which is mounted perpendicular to and rotatable around the optical axis of the exit of the ion source, in order to transfer ions generated in the ion source into different mass spectrometric analyzers depending on rotational angle of the linear rf multipole ion guide.

* * * * *